US008726561B1

(12) United States Patent
Hampton

(10) Patent No.: US 8,726,561 B1
(45) Date of Patent: May 20, 2014

(54) MAGAZINE SPRING COMPRESSION TOOL AND METHOD

(71) Applicant: Thurman B Hampton, Tucker, GA (US)

(72) Inventor: Thurman B Hampton, Tucker, GA (US)

( * ) Notice: Subject to any disclaimer, the term of this patent is extended or adjusted under 35 U.S.C. 154(b) by 0 days.

(21) Appl. No.: 13/691,737

(22) Filed: Dec. 1, 2012

(51) Int. Cl.
*F41A 15/00* (2006.01)

(52) U.S. Cl.
USPC ..... 42/108; 42/106; 42/90; 42/87

(58) Field of Classification Search
USPC ..... 42/108, 87, 106, 90
See application file for complete search history.

(56) References Cited

U.S. PATENT DOCUMENTS

| | | | | |
|---|---|---|---|---|
| 3,509,655 | A * | 5/1970 | Wilhelm | 42/50 |
| 4,509,283 | A | 4/1985 | Chesnut | |
| 4,901,411 | A * | 2/1990 | Chestnut et al. | 42/108 |
| 5,337,505 | A | 8/1994 | Brown et al. | |
| 5,417,003 | A * | 5/1995 | Claveau | 42/90 |
| 6,256,915 | B1 | 7/2001 | da Silveira | |
| 6,389,729 | B2 * | 5/2002 | Rauch et al. | 42/72 |
| 6,640,480 | B2 | 11/2003 | Williams et al. | |
| 7,117,626 | B1 * | 10/2006 | Alzamora et al. | 42/108 |
| 7,257,919 | B1 * | 8/2007 | Farley | 42/87 |
| 7,775,150 | B2 | 8/2010 | Hochstrate et al. | |
| 7,841,472 | B1 | 11/2010 | Williams | |
| 8,146,284 | B2 | 4/2012 | Smith | |
| 8,166,850 | B2 | 5/2012 | Caniparoli et al. | |
| 8,176,667 | B2 | 5/2012 | Kamal et al. | |
| 8,186,092 | B2 | 5/2012 | Williams | |
| D670,784 | S | 11/2012 | Emde | |
| 8,302,342 | B2 | 11/2012 | Krieger | |
| 2013/0074393 | A1 * | 3/2013 | Curry | 42/108 |

* cited by examiner

*Primary Examiner* — J. Woodrow Eldred

(57) ABSTRACT

A tool, implement or apparatus and a method of use of the tool, implement or apparatus to aid in the disassembly and assembly of a firearm magazine for cleaning, maintenance or repair when that magazine has a sealed base plate and requires the removal of the spring and spring follower from the top of the magazine. The tool consists of two parts—a body and a pin. The method consists of using the tool body to apply a pushing force or compressing operation directly to the magazine follower and thereby compressing the follower and the magazine spring. The pin is inserted through the magazine box through witness holes to release spring tension from the follower allowing it to be removed. During reassembly, the tool body is used to apply a pushing force or compressing operation directly to the magazine spring compressing it into the magazine box and holding it in place to allow insertion of the pin through the magazine witness holes and to allow insertion of the follower.

3 Claims, 5 Drawing Sheets

Legend

| | |
|---|---|
| 100 | Magazine Box |
| 101 | Witness Holes |
| 102 | Wide End of Box |
| 103 | Lips of the Magazine |
| 104 | Follower |
| 105 | Spring |
| 106 | Magazine Base |

Legend
100 Magazine Box
101 Witness Holes
102 Wide End of Magazine Box
103 Lips of the Magazine
104 Follower
105 Spring (Compressed)
106 Magazine Base
107 Body of Tool
108 Grooves
112 Pin
113 Rearward Motion of the Tool Body
114 Tool Body in Lock Position
115 Forward Motion to Unlock Tool

MAGAZINE SPRING COMPRESSION TOOL AND METHOD

FIELD OF THE INVENTION

The invention is a tool, implement or apparatus and a method utilizing the tool to aid in the disassembly and assembly of a magazine of a semi-automatic or automatic firearm for cleaning, maintenance or repair when that magazine has a sealed base plate and requires the removal of the spring and spring follower from the top of the magazine. The tool consists of two parts—a body and a pin. The tool and method are used to apply a pushing force or perform compressing operations directly to the magazine follower and to the magazine spring compressing them to a position within the magazine box where the spring can be held in place and the follower removed or reinserted.

BACKGROUND OF THE INVENTION

A magazine stores and feeds ammunition to a firearm. Magazines may be integral to the firearm (fixed) or removable (detachable). The magazine functions by moving the cartridges stored in the magazine into a position to be loaded into the chamber by the action of the firearm. The most popular type of magazine in modern rifles and handguns is a "box" or "tube" magazine that stores cartridges in a column in either one above the other or in a staggered fashion. As the firearm cycles, cartridges are moved to the top of the magazine by a follower driven by spring compression. The components of the typical box magazine are the cartridge box or tube, the spring, the spring follower and the base plate. Typically, the cartridge box contains holes (witness holes or recognition holes) that allow the user to see how many cartridges are loaded in the box.

Because the magazine is inserted into the firearm when it is fired, the magazine collects powder, residue and contaminants like all other parts of the firearm. Cleaning the magazine is a usual and necessary event following actual use of the weapon. Failure to clean the magazine may cause a failure to feed ammunition and a misfire. Cleaning the magazine requires disassembly. Some magazines are disassembled for cleaning by engaging a release mechanism at or in the base plate. On these magazines, the spring typically is fixed in some manner to the base plate. The base plate is removed and the internal components of the magazine can be removed.

Certain magazines, like those designed for and fitting the Colt™ .45 ACP (Automatic Colt Pistol) Government™ and Commander™ models, the Colt Mustang™, the Sig Saur P238™ and P938™ and generic magazines designed to work in the Colt 1911 style .45 caliber pistol have a sealed base plate and require the removal of the spring and spring follower from the top of the magazine. The primary characteristics of these types of magazines are that the base plate is not removable and the spring is not affixed or attached to the box or the base plate (and is therefore removable). Consequently, the internal components of these magazines must be removed from the top or open end of the magazine.

To disassemble these magazines, the user holds the magazine with one hand and inserts a tool, implement or apparatus into the top of the magazine box to compress the spring follower and spring with the other hand. The user must maintain pressure on the spring and follower with one hand. While the spring follower and spring are compressed, the user insert a small punch or pin through one of the cartridge witness holes in the magazine box at a point below the bottom of the follower to capture the magazine spring and relieve tension from the follower. When the spring is captured and locked in place, the user removes the tool, implement or apparatus that was inserted through the top of the magazine to compress the spring and follower. The magazine is turned upside down and the spring follower is removed. The small punch or pin used to lock the spring in place is then removed and the spring is removed. The magazine and its components can be cleaned.

To reassemble the magazine, the spring is inserted into the box from the top and then compressed using a tool, implement or apparatus. When the spring is compressed, the user captures the magazine spring by inserting a small punch or pin through one of the cartridge witness holes in the magazine tube. The user then inserts the spring follower and releases the spring by removing the small punch or pin from the magazine's cartridge witness hole. This action applies tension to the bottom of the follower forcing it to the top of the magazine box where it stops.

Currently, there is no single tool that the typical user can employ to compress the spring and hold it in place for disassembly or assembly. The typical user employs metal punches, small nails or other pins and readily available shop supplies as tools or implements to capture the spring and lock it into place. Use of these types of implements leads to or promotes wear on the magazine and its components.

SUMMARY OF THE INVENTION

Various aspects of the invention are novel, non-obvious and provide various advantages. While the actual nature of the invention covered herein can be determined only with reference to the claims appended hereto, certain features which are characteristic of the preferred embodiment can be described briefly.

The invention is a two piece tool, implement or apparatus for applying a pushing force or performing compressing operations directly to the spring follower, and consequently to the spring of a magazine for a semi-automatic or automatic firearm and a method to utilize the tool to compress the spring and the follower to a position where the spring can be held in place and the spring follower removed or reinserted. The tool and method aid in the disassembly and assembly of a magazine for purposes of cleaning, maintenance or repair. The invention works with and on magazines of the type designed for and fitting the Colt™ .45 ACP (Automatic Colt Pistol) Government™ and Commander™ models; the Colt Mustang™; and, the Sig Saur P238™ and P938™ models. The magazines for these weapons have a sealed base plate and require the removal of the spring and spring follower from the top of the magazine. The invention will work, however, in any magazine in which the base plate is not removable, the spring is not affixed or attached to the box or the base plate (and is therefore removable) and the spring and spring follower are removable from the top of the magazine. During disassembly, the invention allows the user to compress and hold the magazine spring, to release tension on the spring follower and to remove the spring follower through the top of the magazine. During reassembly of the magazine, the invention is used to compress the magazine spring to a point within the magazine to allow insertion of the follower, to hold the spring in place until the follower is inserted and to release the spring to catch and hold the follower at the top of the magazine.

The tool portion of the invention consists of two parts—a body and a pin. The body is the longer part. The body is constructed of metal, thermoplastic resin or any other material that has sufficient tensile strength to withstand the force of the spring pushing against the body. The tool can be constructed for use in any size or caliber magazine or a combination of sizes. The invention can be configured as a square, a triangle or a rod (round) or other shape. The size will vary with the cartridge diameter for a particular application. The body contains grooves along either side that allow it to lock into place when pushed against the lips of the magazine and thereby hold the follower and spring in the compressed state.

The second piece or part of the tool is a shank or pin (hereinafter "pin"). The pin is longer than the magazine is wide and, therefore, is long enough to go completely through the magazine from one side to the other using the magazine's witness holes. The pin can be housed in a cap or may be inserted into a cavity in the tool body. When housed in a cap, the cap is the same configuration as the body and attaches to the body using a typical snap on or screw on feature for which no innovation is claimed. The cap is constructed of the same material as the body and is configured in the same shape as the body. The pin, however, must be constructed of material that has sufficient tensile strength to withstand the force of the spring pushing against the pin. The circumference of the pin must be smaller than the circumference of the witness holes for the specific magazine on which the invention is used.

The method of operation applies in both disassembly and reassembly of the magazine. During disassembly, the body is used to depress the follower that sits directly on top of the magazine spring. Depressing the spring follower compresses the magazine spring. When the follower and spring are compressed to a depth sufficient to allow removal of the follower, the body of the tool is locked in place between the magazine lips and thereby, holding the spring and follower in place. The pin is inserted through witness holes at a point below the follower to hold the spring in place and release spring tension on the follower. The magazine is turned upside down and the follower is removed. During reassembly of the magazine, the body of the tool is used to compress the spring to a depth that will allow insertion of the follower. The body of the tool is locked in place between the magazine lips and holds the spring in place. The pin is inserted through witness holes at a point below the tool tip to hold the spring in place and release the tension on the tool. The tool is removed and the user inserts the follower. The pin is removed and the spring moves upward applying tension on the follower.

BRIEF DESCRIPTION OF THE DRAWINGS

The accompanying drawings, which are incorporated in and constitute a part of this disclosure, illustrate various embodiments of the present invention. While the actual nature of the invention covered herein can be determined only with reference to the claims appended hereto, certain features which are characteristic of the preferred embodiment can be described briefly. In the drawings:

GENERAL DESCRIPTION

Figure 1:
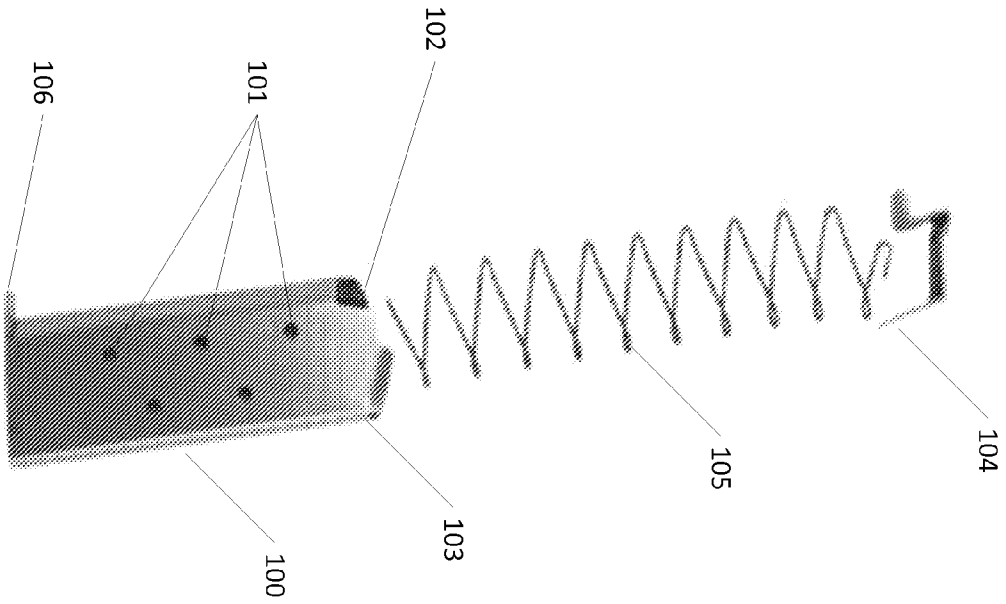
FIG. 1 is a depiction of a typical semi-automatic pistol magazine showing its component parts. Parts shown are: the Magazine Box; Witness Holes; Wide End of Box; Lips of the Magazine; Follower; Spring; and Magazine Base.

The invention is a tool, implement or apparatus and a method utilizing the tool to aid in the disassembly and assembly of a magazine of a semi-automatic or automatic firearm for cleaning, maintenance or repair when that magazine has a sealed base plate and requires the removal of the spring and spring follower from the top of the magazine. The tool consists of two parts—a body and a pin. The tool and method are used to apply a pushing force or perform compressing operations directly to the magazine follower and to the magazine spring compressing them to a position within the magazine box where the spring can be held in place and the follower removed or reinserted.

The first embodiment of the invention, the tool, consists of two parts; a body and a pin. The body is the longer part. The body is constructed of metal, thermoplastic resin or any other material that has sufficient tensile strength to withstand the force of the spring pushing against the body. The tool can be constructed for use in any size or caliber magazine or a combination of sizes. The body can be configured as a square, a triangle or a rod (round) or other shape. The size will vary with the cartridge diameter for a particular application. The body contains grooves along either side that allow it to lock into place when pushed against the lips of the magazine and thereby hold the follower and spring in the compressed state.

The second piece or part of the tool is a shank or pin (hereinafter "pin"). The pin is longer than the magazine is wide and, therefore, is long enough to go completely through the magazine from one side to the other. The pin can be housed in a cap or may be inserted into a cavity in the tool body. When housed in a cap, the cap is the shorter than the body but is the same configuration as the body and attaches to the body using a typical snap on or screw on feature for which no innovation is claimed. The cap is constructed of the same material as the body and is configured in the same shape as the body.

The pin may be inserted into and made part of the cap during the manufacturing process, a totally independent shank or pin that is inserted into a cavity within the body for storage. The pin, however, is constructed of material that has sufficient tensile strength to withstand the force of the spring pushing against the pin. The circumference of the pin must be smaller than the circumference of the witness holes for the specific magazine on which the invention is used.

The second embodiment is a method for use of the tool described as the first embodiment. During disassembly, the user inserts the body portion of the invention into the wide end of the top of the magazine to depress the spring follower and compress the spring. The spring must be compressed to a depth sufficient to allow removal of the spring follower. Typically, the proper depth equals or exceeds the length (flat side) of the cartridge magazine. For operational purposes, the proper depth is usually equal to at least 1.5 times the length of the cartridge.

Once depressed to a sufficient depth, the user moves the body in a backward motion to lock into the lips of the magazine (the smaller end of the magazine) using the grooves along the side of the tool body. This action holds the spring and spring follower in place. The user inserts the pin (from the cap of the invention) through witness holes on either side of the magazine and through the magazine box at a point below the spring follower. The pin holds the spring in place and releases tension on the spring follower.

The user removes the tool body from the top of the magazine box. Following manufacturer's instructions, the user removes the follower. Typically, the user removes the follower by turning the magazine upside down. The user covers the top of the magazine with a hand or finger and removes the pin from the witness holes. The user captures the spring (which is under force) as it moves forward and out of the magazine box. The user then removes the spring from the magazine box.

During reassembly, the user inserts the spring into the magazine box. The user compresses the spring pushing it down and into the magazine box using the tool body. The user compresses the spring to a depth sufficient to allow insertion of the spring follower. Typically, the proper depth equals or exceeds the length of the cartridge magazine. For operational purposes, the proper depth should equal or exceed 1.5 times the length of the cartridge. Once depressed to a sufficient depth, the user inserts the holding pin through the magazine box via witness holes. This action holds the spring in place and allows removal of the tool body. Following manufacturer's instructions, the user inserts the follower. The user removes the holding pin and the spring snaps forward capturing the follower and moving it to the top of the magazine.

DETAILED DESCRIPTION

Figure 2:
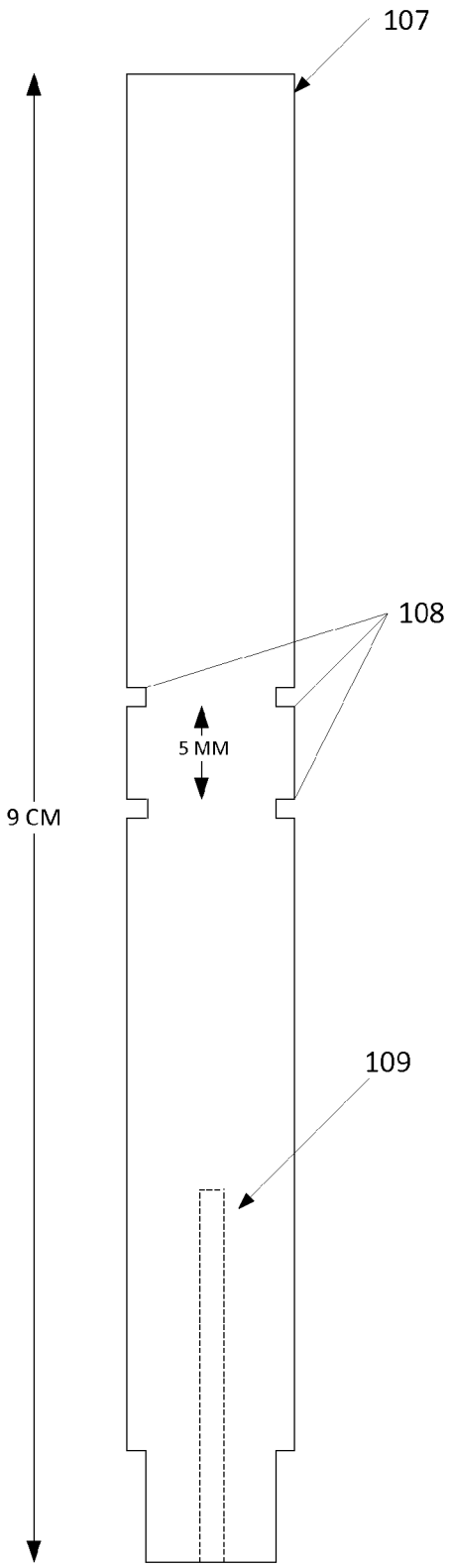
FIG. 2 is a depiction of the front view of the tool body. For purposes of non-limiting illustration, the tool body is shown as a square whose side to side dimensions equal the diameter of the cartridges intended for use in a specific caliber magazine.
Figure 2A:
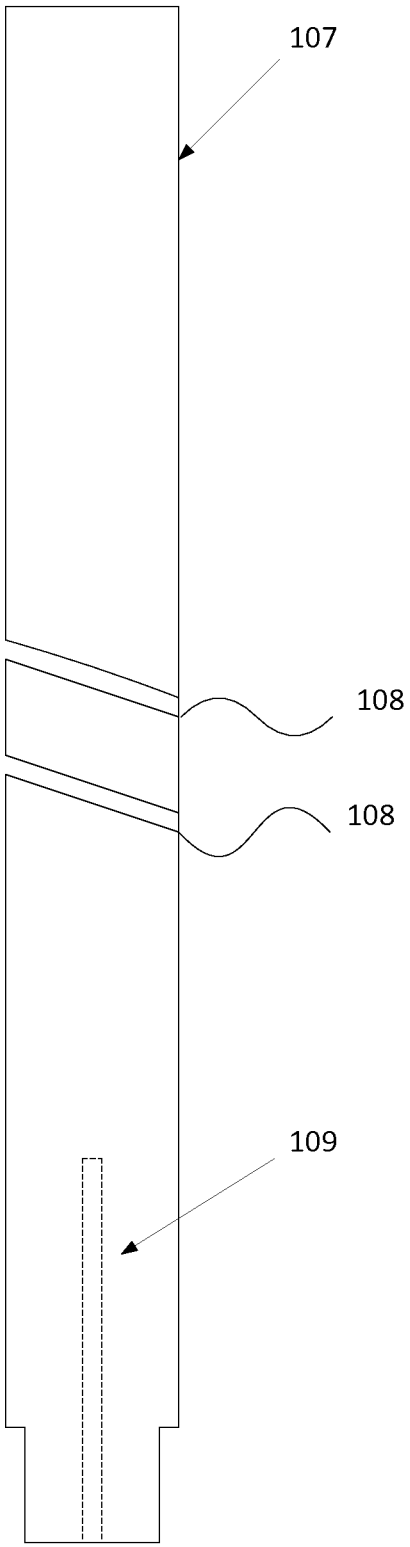
FIG. 2A is a depiction of the side view of the tool body showing the groves on either side that allow the tool to lock into the lips of the magazine.
Figure 2B:
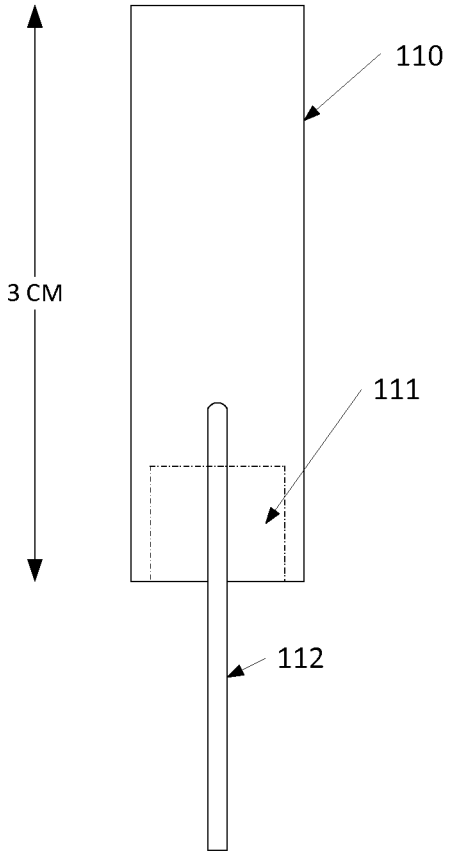
FIG. 2B shows the pin or shank portion of the tool. For non-limiting illustrative purposes, the pin is housed in a cap.

FIGS. 2, 2*a* and 2*b* illustrate the first embodiment of the invention. Although the descriptions that follow contain much specificity, these should not be construed as limiting the scope of the embodiment but as merely providing illustrations of the kind of operations conducted by the embodiment. Thus, the scope of the embodiment should be determined by the appended claims and their legal equivalents rather than by the examples given.

The first embodiment of the invention is a tool, implement or apparatus for applying a pushing force or performing compressing operations directly to the spring follower, and consequently to the spring of a magazine for a semi-automatic or automatic firearm with the intention to compress the spring and the spring follower to a position where the spring can be held in place and the spring follower removed or reinserted.

The embodiment aids in the disassembly and assembly of a firearms magazine for purposes of cleaning, maintenance or repair. The invention works with and on magazines of the type designed for and fitting the Colt™ .45 ACP (Automatic Colt Pistol) Government™ and Commander™ models; the Colt Mustang™; and, the Sig Saur P238™ and P938™ models. FIG. 1 illustrates the components and structure of this type of magazine. The magazines for these weapons have a sealed base plate 106 and require the removal of the spring 105 and spring follower 104 from the top of the magazine. The invention will work, however, in any magazine in which the base plate is not removable, the spring is not affixed or attached to the box or the base plate (and is therefore removable) and the spring and spring follower are removable from the top of the magazine.

The first embodiment of the invention consists of two parts—a body 107 and a m pin 112. FIGS. 2 and 2A illustrate the body of the invention, which is the longer part. For purposes of non-limiting illustration, the tool body is shown as a square whose side to side dimensions equal the diameter of the cartridges intended for use in a specific caliber magazine. The body 107 contains grooves 108 along opposite sides that allow the body to lock into place when pushed against the lips of the magazine 103. The body 107, with cap 110 attached is 12 centimeters (approximately 5 inches) long. FIG. 2B is a non-limiting illustration of pin housed in a cap which is the same shape and side to side dimensions as the body and is constructed of the same material as the body. The preferred and non-limiting illustration uses a metal pin 112 inserted in the cap during the manufacturing process that is approximately 0.067 inches in diameter. The pin 112 may, however, be molded of the same material as the body 107 but the material must allow the pin to withstand the pressure of the spring pushing against it without breaking or binding. In addition, the circumference of the pin must be smaller than the circumference of the witness holes of the magazine. The preferred and non-limiting illustration uses a cap that is approximately 3 centimeters long and a pin (whether molded or inserted) with an exterior length from a preferred 1 to 1.5 centimeters (0.394-0.591 inches) to a maximum of 2 centimeters (0.787 inches) in length.

The invention 107 can be configured in different shapes including a square, a triangle or a rod and can be constructed of thermoplastic resins (general purpose, engineered plastics, glass and fiber reinforced plastics), metal, alloys, composite materials, or ceramics or other material that has sufficient tensile strength to with stand the force of the spring acting against the pin or the body. The invention 107 can be constructed for use in any size or caliber magazine. The body of the tool 107 can be constructed to work in only one size or in multiple sizes. The dimensions of the body will depend upon the shape of the invention and the cartridge diameter for a particular application. Table 1 shows the caliber and corresponding dimensions of typical cartridges of the most popular semi-automatic firearms.

Figure 3:
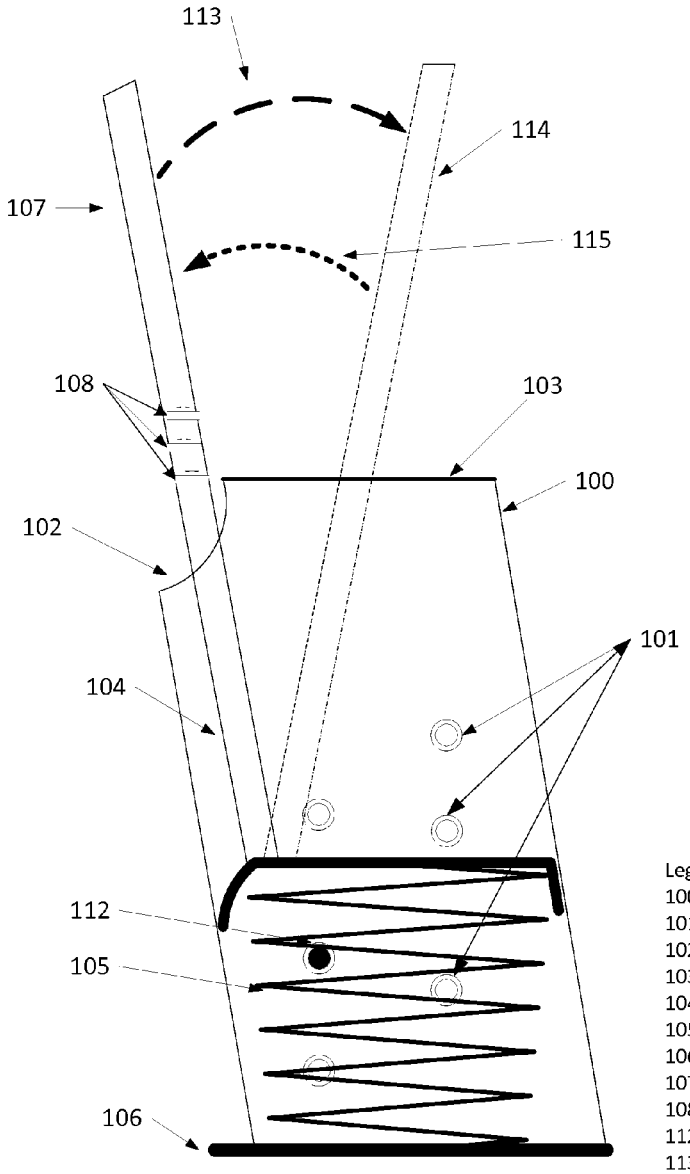
FIG. 3 depicts the operation or utilization of the tool.

FIG. 3 illustrates a second embodiment of the invention, which is the method of use of the tool to disassemble the magazine and to reassemble the magazine. During disassembly, the user holds the magazine in one hand and inserts the body 107 into the wide end 102 of the top of the magazine box. The user depresses the follower 104 and simultaneously compresses the spring 105 to a depth sufficient to remove the follower. Typically, the magazine 100 and follower 104 are only marginally wider (flat side width) than the cartridge is long. Therefore, depressing the follower 104 and spring 105 to a depth equal to 1.5 times the length of the cartridge should create sufficient space for removal of the follower. For illustrative purposes only: if used with a .380 caliber magazine, the user would depress the body of the tool 107 at least 1.47 inches (37.5 millimeters) or more to create sufficient room to remove the follower. See Table 1.

Each manufacturer determines the placement of the witness holes. Consequently, the depth to which the follower and spring are compressed will be affected also by the location of witness holes and the grooves along the side of the body of the tool 107. So, for non-limiting illustrative example, the first grooves along the sides of the tool designed to work in a .380 caliber magazine will begin 1 inch (25 millimeters) from the tip of the tool (the end inserted into the magazine) and continue every 0.19685 inches (5 millimeters) for another two inches (50 millimeters).

TABLE 1

| Cartridge Dimensions | | | | |
|---|---|---|---|---|
| | Base Diameter | | Cartridge Length | |
| Caliber | Inches | MM | Inches | MM |
| .380 | .374 | 9.50 | .984 | 25.00 |
| .38 | .379 | 9.60 | 1.55 | 39.00 |
| 9 MM | .392 | 9.96 | 1.169 | 29.69 |
| .357 Sig ™ | .424 | 10.77 | 1.140 | 28.96 |
| .40 S&W ™ | .424 | 10.80 | 1.135 | 28.80 |
| .45 Colt Auto ™ | .476 | 12.10 | 1.275 | 32.40 |

Once compressed to a depth sufficient to remove the follower 104, the user moves the body 107 in a backward motion 113 to lock into the lips of the magazine 103 (the smaller end of the magazine) 114 using the grooves 108 on either side of the tool 107. Once the tool is locked in place, the user inserts the pin 112 through witness holes 101 on either side of the magazine 100. The user inserts the pin 112 underneath the follower 104 and between the spring spirals 105. This releases spring 105 tension on the follower 104. The user removes the tool body 107 by moving it forward 115 and off the magazine lips 103. Following manufacturer's instructions, the user removes the follower 104. Typically, the follower is removed by turning the magazine upside down. After the follower 104 is removed, the user covers the top of the magazine with a hand or finger and removes the pin from the witness holes. The user captures the spring 105 (which is under force) as it moves forward. The spring 105 can be removed from the magazine box 100.

During reassembly of the magazine, the tool 107 is used to compress the magazine spring 105 to a point within the magazine to allow insertion of the follower 104. The user inserts the spring 105 into the magazine box following manufacturer's instructions. Using the tool 107, the user compresses the spring to a point that will allow insertion of the follower. The user must depress the follower to a depth exceeding the long side width of the follower. Typically, the magazine is only marginally wider (flat side width) than the cartridge is long. Therefore, depressing the follower 104 and spring 105 to a distance equal to 1.5 times the length of the cartridge typically will create sufficient space for inserting the follower. For non-limiting illustrative purposes: if used with a .380 caliber magazine, the user would depress the tool at least 1.47 inches (37.5 millimeters) or more to create sufficient room to insert the follower. See, Table 1.

Each manufacturer determines the placement of the witness holes. Consequently, the depth to which the spring is compressed will be affected also by the location of witness holes and the grooves along the side of the tool 107. So, for non-limiting illustrative purposes, the first grooves along the sides of the tool designed to work in a .380 caliber magazine will begin 1 inch (25 millimeters) from the tip of the tool (the end inserted into the magazine) and continue every 0.19685 inches (5 millimeters) for another two inches (50 millimeters).

When the spring 105 is compressed to a sufficient depth, the user slides the tool 107 in a rearward motion to lock the tool in the lips 103 (small end) of the magazine 100. The user inserts the holding pin 112 through the magazine box 100 via the witness holes 101. This holds the spring 105 in place and allows insertion of the follower 104. Following manufacturer's instructions, the user inserts the follower 104. The user removes the tool body 107 and covers the top of the magazine with a hand or finger to capture the follower as it is driven upward by the spring. The user then removes the holding pin 112. The spring 105 snaps forward capturing the follower 104 and moving it to the top of the magazine 100.

What is claimed:

1. A two piece tool consisting of a body (piece 1) and a retaining pin (piece 2) for disassembly and reassembly of a firearms magazine for cleaning or maintenance, said magazine consisting of a case having a hollow generally rectilinear configuration with two flat parallel side faces, a front face, a rear face and a base end with a non-removable base plate and an open upper end, the base plate formed in a flat generally rectangular configuration and coupled to the base end to close the base end thereby forming an interior recess within the case, the upper open end having a wide section equal to the dimensions of the flat edge of the cartridge to be inserted into the magazine, the upper ends of the side faces having a radial bevel to form a lip on both sides thereby restricting the opening into the recess of the case, said feed lips having a length and a clearance, a coil spring having an upper end and a lower end positioned on but not attached to the base plate and sized to be slightly longer than height of the interior recess of the case;

a follower positioned within the recess and upon the spring having a central section for positioning the spring and is adapted to smoothly slide up and down within the recess without binding, and witness holes along the sides of the magazine case that are parallel to one another, and said tool consisting of a body that includes channels on opposite sides of the body, said channels having a width that is less than the clearance between the feed lips and a second surface width above and below the channels that is greater than the clearance between the feed lips but equal to the dimensions of the flat edge of the cartridge to be inserted into the magazine, and consisting of a retaining pin which is smaller in diameter than the witness holes in the magazine, is no longer than the length of a cartridge intended for use in the magazine and, is inserted into a recess in the tool body for storage said retaining pin being.

2. A method to disassemble a firearms magazine for cleaning or maintenance consisting of the tool described in claim 1 and the magazine described in claim 1 and accomplished by inserting the tool body into the wide section of the open upper end of the magazine to rest on top of the follower using the tool to depress the follower and spring to a depth equal to twice the length of the cartridge that goes into the magazine or to the point where the channels on the side of the tool are aligned to the lips of the magazine sliding the tool body toward the rear face of the magazine and engaging the lips of the magazine by sliding the lips into the channels on each side of the magazine inserting the retaining pin through the witness holes in the magazine box at a place where the pin is beneath the follower to capture the magazine spring removing the tool body and maneuvering the follower until it falls out or is removed from the magazine.

3. A method to assemble a firearms magazine after cleaning or maintenance consisting of the tool described in claim 1 and the magazine described in claim 1 and accomplished by inserting the spring into the magazine from the open upper end using the hand using the tool body (piece 1) depress the spring to a depth equal to twice the length of the cartridge that goes into the magazine or to the point where the channels on the side of the tool are aligned to the lips of the magazine slide the tool body toward the rear face of the magazine and engage the lips of the magazine by sliding the lips into the channels on each side of the magazine insert the retaining pin (piece 2) through the witness holes in the magazine to capture the magazine spring remove the tool body insert the follower through the open upper end of the magazine and maneuver it so that the central section is positioned on the spring remove the retaining pin.

* * * * *